US006357622B1

(12) United States Patent
Ayotte

(10) Patent No.: US 6,357,622 B1
(45) Date of Patent: Mar. 19, 2002

(54) AUTOMATIC ELECTRONIC DROP-SHELF COIN OPERATED MECHANISM

(76) Inventor: Leo F. Ayotte, 26 Orestis Way, Lewiston, ME (US) 04240

( * ) Notice: Subject to any disclaimer, the term of this patent is extended or adjusted under 35 U.S.C. 154(b) by 0 days.

(21) Appl. No.: 09/368,065

(22) Filed: Aug. 3, 1999

Related U.S. Application Data

(60) Provisional application No. 60/095,328, filed on Aug. 4, 1998.

(51) Int. Cl.[7] ..... G07F 11/06
(52) U.S. Cl. ..... 221/90; 221/82
(58) Field of Search ..... 221/90, 89, 82, 221/69, 15

(56) References Cited

U.S. PATENT DOCUMENTS 3,087,649 A * 4/1963 Leonard et al. ..... 221/90
3,163,326 A * 12/1964 Sabin et al. ..... 221/90
3,752,358 A * 8/1973 Ohno ..... 221/90
3,802,601 A * 4/1974 Ohno ..... 221/90
4,190,178 A 2/1980 LeBron, III ..... 221/90
4,284,206 A * 8/1981 Wittern ..... 221/90
4,284,207 A 8/1981 Christian ..... 221/90
4,411,375 A 10/1983 Christian ..... 221/90
5,240,142 A * 8/1993 Reid ..... 221/90 X
5,586,684 A * 12/1996 Halsey et al. ..... 221/90
5,660,304 A * 8/1997 Halsey et al. ..... 221/90 X

* cited by examiner

*Primary Examiner*—Christopher P. Ellis
*Assistant Examiner*—Patrick Macker
(74) *Attorney, Agent, or Firm*—Pandiscio & Pandiscio

(57) ABSTRACT

An electronic drop-shelf vending device used within the vending industry to dispense packaged products. The device is a fully automatic and trouble-free electronic dispensing system that includes a micro-switch, a terminal block, a transformer, a solenoid, an electronic accumulative timing control module, an electronic multi-coin and/or multi token acceptor, and wiring interconnects. All of these components are operable together with one or more drop-shelf magazines in order to control the dispensing of the given packaged product by the action of the drop-shelf magazine via electronic triggering and electromechanical actuation.

21 Claims, 4 Drawing Sheets

AUTOMATIC ELECTRONIC DROP-SHELF COIN OPERATED MECHANISM

CROSS-REFERENCE TO RELATED APPLICATIONS

This application claims priority under Title 35, U.S. Code Section 119(e) of the U.S. provisional patent application Serial No. 60/095,328 filed on Aug. 4, 1998.

BACKGROUND OF THE INVENTION

1. Field of Invention

The present invention relates generally to the field of devices for automated point-of-sale vending. More particularly, the present invention relates to a device for providing efficient, problem-free vending by minimizing purely mechanical elements and instead combining the use of electrical and electronic elements. More particular yet, the present invention involves a drop-shelf vending machine of the electronically controlled electromechanical type.

2. Description of Prior-art

While the general field of vending machines involves a variety of methods for actuation such as auger-type dispensing or manual selection from a stack (e.g., newspaper vending machines), the more specific type of drop-shelf actuation will be discussed. Commonly, mechanical mechanisms are used to dispense products from such drop-shelf vending machines. These prior-art mechanical systems are prone to failure due to many factors including corrosion of the precision metal surfaces and the large number of precision mechanical parts used to activate the drop shelves.

In spite of contemporary advances in vending machine technology, a cost-effective electronic and electromechanical drop-shelf vending machine is notably absent in the vending industry. While attempts have been made to vend products (e.g., detergent boxes, snacks, and sundries) that are more suited to drop-shelf dispensing using a variety of other vending techniques, these attempts have not gained acceptance within the vending machine industry. Several reasons for such non-acceptance exist and include the relative high cost and low reliability (e.g., jams and the like) of current vending technologies. As well, current vending technologies have not been economically feasible due to the length of time required for service and loading which drastically increases operational costs.

From the operation described above, it becomes critically apparent that current vending technologies are generally inadequate for vending industry purposes. Further, it is apparent that current drop-shelf technologies are sorely antiquated. Among the prior-art references, several known devices typify the aforementioned drop-shelf method and some attempt to alleviate the problems associated with such a purely mechanical design. However, none of these below patents touch the disclosure of this invention as described herein.

The device of U.S. Pat. No. 4,411,375 issued to Christian is drawn to a shelf arrangement for a drop-shelf vending machine. This prior-art device is directed to use for newspapers and the like wherein the shelves are staggered or of varying width to enable the loading or unloading of several shelves at any one given time.

The device of U.S. Pat. No. 4,284,207 issued to Christian is drawn to a mechanical system for supporting, releasing, and resetting the shelves of a drop-shelf vending machine. The mechanical system includes a pawl with a double-sided actuating ramp retracted by an extended roller chain link pin.

Such a design is inherently problematic due to the mechanical complexity of so numerous an amount of parts.

The device of U.S. Pat. No. 4,190,178 issued to LeBron, III is drawn to a drop-shelf vending mechanism that includes mechanical trigger actuation. More particularly, the triggers are spring biased and have mechanical stops that indicate a sold-out status for a given item as appropriate. The stops also prevent further trigger actuation by a user when the given item is sold-out.

While these prior-art devices represent improvements within mechanical arrangements, none of the patents discussed above adequately provides for any electronic or electrical mechanisms that would automate the drop-shelf operation. Common to the prior-art devices, a multitude of moving mechanical parts are required. Such numerous mechanical parts are particularly prone to failure due to dust and dirt buildup. Intermittent failures cause products to jam within the vending machine thus requiring costly servicing. Ultimate failure requires costly repair or replacement. None of the prior-art devices teach or render obvious the automated electronic drop-shelf vending machine of the present invention wherein the drop-shelf is electrically actuated via a controller that is electronically triggered by insertion of monies by the user.

Accordingly, it is desirable to provide for a new and improved, effective drop-shelf vending device for providing relatively maintenance-free operation suitable for automated point-of-sale vending purposes such as, but not limited to, newspapers, magazines, packaged food or cleaning products, assorted sundries, and the like. What is needed is such a drop-shelf vending device that is easily operated. What is also needed is such a drop-shelf vending device that can be utilized to retrofit prior-art drop shelving machines in order to reduce the number of mechanical parts and increase overall vending reliability. What is further needed is such a drop-shelf vending device that does not require complex and specialized springs, levers, sprockets, pivots, . . . etc., but instead can operate reliably with electronic controllers, circuitry, and electromechanical actuators. Still, what is needed is such a drop-shelf vending device that includes easily serviceable components. What is also needed is such a drop-shelf vending device that can be modularized such that sections may be easily replaced or updated. Still further, what is needed is such a drop-shelf vending device which overcomes at least some of the disadvantages of the prior-art while providing new and useful reliable electric and electronic features.

SUMMARY OF THE INVENTION

It is an objective of the present invention to provide a drop-shelf vending device that provides relatively maintenance-free operation suitable for automated point-of-sale vending purposes such as, but not limited to, newspapers, magazines, packaged food or cleaning products, assorted sundries, and the like. It is another objective of the present invention to provide a drop-shelf vending device that is easily operated. Still another objective of the present invention is to provide a drop-shelf vending device that can be utilized to retrofit prior-art drop shelving machines in order to reduce the number of mechanical parts and increase overall vending reliability. It is an objective of the present invention to provide a drop-shelf vending device without reliance on complex and specialized mechanical elements such as springs, levers, sprockets, pivots, and the like, but instead operates reliably by means of electronic controllers, circuitry, and electromechanical actuators.

Another objective of the present invention is to provide a drop-shelf vending device that includes easily serviceable components. Yet another objective of the present invention is to provide a drop-shelf vending device being able to be modularized such that sections may be easily replaced or updated.

The present invention is directed to an electronic drop-shelf vending device that is used within the vending industry to dispense packaged products. Such packaged products include virtually any type of consumer product including, without limitation, candies, chips, and assorted snack items; personal products such as soaps, toothpaste, and other hygienic products; print items such as newspapers or magazines; and any other relatively compact item suitable for placement within a drop-shelf. The invention is an improvement over the existing mechanical drop shelf vending machine in that the instant drop-shelf vending device is a fully automatic and trouble-free electronic dispensing system that is free of push/pull mechanical knobs. Such a user-friendly system can include an indicator means located remote from the device (e.g., in an adjacent office) to warm of a low product supply within the shelves. The inventive system also allows for independent pricing on each column of shelves on multi-column arrangements. This allows for mixing of products with differing prices.

The electronic drop-shelf vending device of the present invention is an assembly having electronic and electromechanical devices such as, but not limited to, micro switches, terminal boards, 24 volt direct current (DC) or 120 volt alternating current (AC) electronic pull type solenoids, electronic accumulative timing control modules, electronic multi-coin and/or multi token acceptors, and wiring interconnects. All of these components are operable together with either a single drop-shelf magazine (i.e., single column) or multiple drop-shelf magazines (i.e., multi-column) in order to control the dispensing of the given packaged product by the action of the drop-shelf magazine via electronic triggering and electromechanical actuation.

The electronic drop-shelf vending device includes an easy-to-read digital display. A coin-counter display within the device allows for remote money counting and can be reset from the device itself or from a remote site (e.g., an adjacent or central office). The use of electronics and electromechanical elements results in troublefree electronic action that performs well in a large temperature range including low and high extremes. This is particularly useful in outdoor settings such as car-washes, beaches or poolsides, athletic fields or tennis courts, and similar locations. The device also includes features that allow a range of pricing (e.g., $0.25 to $4.00) as appropriate as well as an automatic coin return when shelves are empty. Structurally, the device can be made compact such as for wall-mounting. Alternatively, the device can be a large, free-standing vending machine that is weighted so as to prevent vandalism. Of course, either configuration may include windows so as to enable a purchaser to view the products. However, anti-vandal configurations may simply include photographs or pictures of the products on the exterior surface of the device's case (e.g., sheetmetal, high-impact plastic, or some similarly durable casing material).

In operation, the electronic drop-shelf vending machine of the present invention drops a shelf containing a product when the correct amount of coins, tokens, or paper currency has been deposited into a provided money slot. The coins, tokens or paper currency are dropped or pulled in a currency-accepting device. Such money slots and currency-accepting devices are well known in the art of vending machines and numerous types of these structures may be used so long as a suitable electronic pulse may be derived from such structure. That is to say, such structure should be an electronic type of currency-accepting device. This includes structures such as card readers that utilize credit-cards, debit-cards, or pre-paid smart-cards. Once some monetary form is input, the currency-accepting device then sends an electronic pulse to the timing module. The device owner or vending company to set products to a predetermined currency value uses the timing module. The timing module determines that the correct amount of tokens, coins, or currency was received according to the predetermined currency value setting. If the value is correct, the timing module allows an electronic pulse to activate a solenoid or some similar electromechanical actuator.

The electric pulse to the solenoid activates the solenoid's plunger, which is attached to the trigger mechanism of the drop-shelf magazine. This activation of the drop-shelf magazine trigger mechanism forces a shelf containing a product to drop. Thus, the selected product is discharged from the device for access by the consumer. As the electric current is cut off to the solenoid by the timing module, the drop-shelf magazine trigger is pulled back to its original position by spring action. In this manner, the device is made ready for its next vend.

The inventive system is easily adaptable to any number of tokens, quarters, dollar coins or paper money and to multi-column drop-shelf vending equipment incorporating mechanically operated drop-shelf magazines. This invention provides a reliable electronic and electromechanical drop shelf vending machine that is within the cost range of most customers.

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

DETAILED DESCRIPTION OF THE PREFERRED EMBODIMENT

Figure 1:
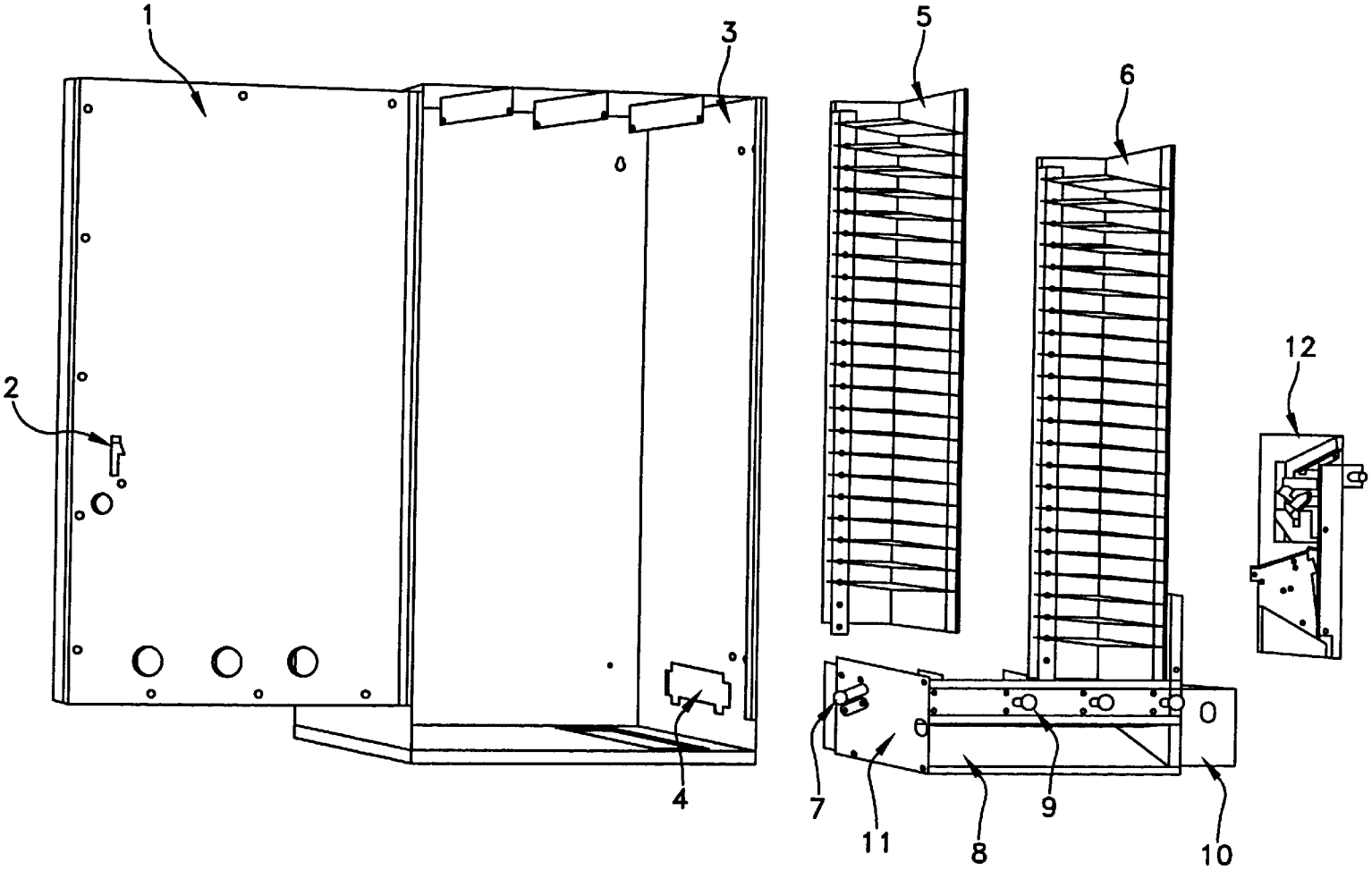
FIG. 1 (PRIOR ART)
FIG. 1 is an exploded view of a prior-art drop-shelf vending machine of the common mechanical type.

The present invention is directed to an automatic electronic drop-shelf vending device useful for vending consumer products such as, but not limited to, candies, chips, assorted snack items, personal products such as soaps, toothpaste, and other hygienic products, print items such as newspapers or magazines, and any other relatively compact item suitable for placement within a drop-shelf.

Accordingly, it should be noted that although a single drop-shelf set is shown vending window cleaner in the drawings described herein, this is only meant to illustrate the invention and not meant to limit the invention to this particular configuration and use.

Referring now to FIG. 1, there is shown an exploded view of a prior-art drop-shelf vending machine of the mechanical type. This prior-art machine includes a cabinet 3 with a door 1, a coin deflector 2 and a coin box door 4. Also shown are two drop-shelf magazines 5 and 6. Each magazine 5, 6 is mounted in a mechanical vend mechanism 11 that includes a main mechanical shaft and gear element 7, a delivery chute 8, mechanical knobs 9, and a coin box 10. For placement between the coin deflector 2 and the coin box 10, there is a mechanical coin mechanism 12 that mechanically unlatches the knobs 9 upon insertion of sufficient coins therein. This purely mechanical type of drop-shelf vending machine represents the state of the art in drop-shelf vendors until now.

Figure 2:
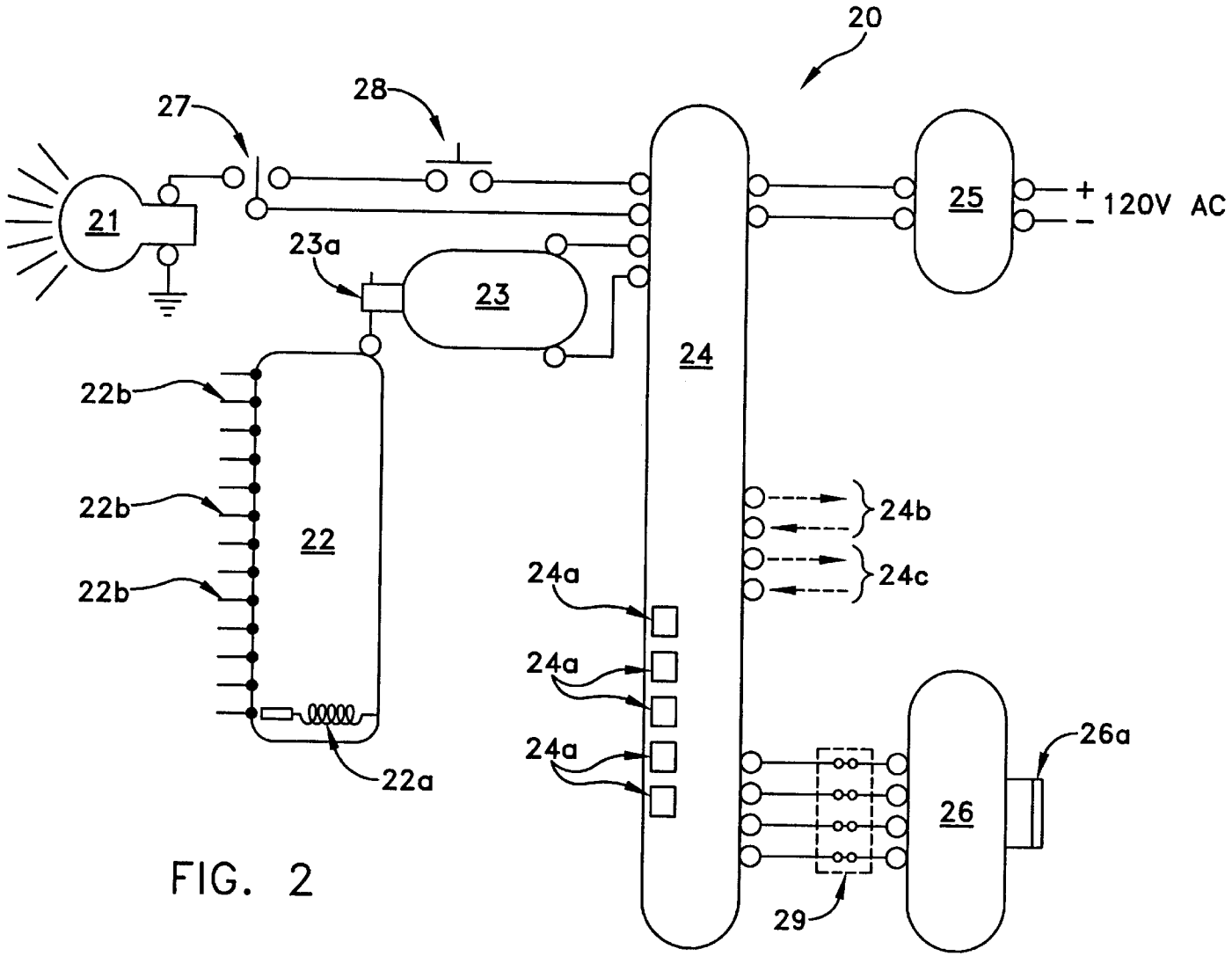
FIG. 2 is a schematic diagram of an automatic electronic drop-shelf device according to the present invention.

Referring now to FIG. 2, there is shown a schematic showing an electronic drop-shelf vending device 20 according to the preferred embodiment of the present invention. In FIG. 2, power from a typical 120V AC power source is brought into a transformer 25. All connections are made via wiring harnesses typical in the electronics industry. The transformer 25 provides the operating voltage to the device 20. Preferably, the transformer 25 is a 24V AC/DC transformer. However, it should be noted that any other type of power arrangement is possible especially if lower voltages (e.g., 5V or 3V) are required for the particular circuitry utilized. The transformer 25 is connected to a timing element 24. The timing element 24 is an electronic accumulative timing control module that is programmable to the extent that an individual may set a price for a given product and program such price into the timing element 24 via price settings 24*a*. In addition, the timing element 24 can be remotely monitored and reset as needed via the coin pulse output 24*b* and the coin totalizer reset 24*c*, respectively.

With continued reference to FIG. 2, a coin detector 26 is connected to the timing element 24 via a terminal block 29. By using a terminal block 29 in lieu of direct connection, the coin detector 26 may be one of any variety of monetary devices including electronic acceptors of coins, tokens, paper currency, and card readers that utilize credit-cards, debit-cards, or pre-paid smart-cards. Indeed, the terminal block 29 allows for easy replacement or upgrading of the coin detector 26 if so desired. The device 20 as shown also includes a push-button switch 28, a micro-switch 27, a solenoid 23, an empty indicator 21, and a drop-shelf magazine 22.

The timing element 24 is connectable to the empty indicator 21 via the push-button switch 28 and micro-switch 27. More specifically, the push-button switch 28 is a normally open switch that is closed when a user of the device makes a purchase selection. In the event that all of the prospective selections are sold out, the timing element 24 will send a signal to complete the circuit of the micro-switch 27 through the empty indicator 21 to ground and prevent the solenoid 23 from operating. Thus the empty indicator 21 will signal to the user that his or her selection is sold out. In contrast, when the drop-shelf magazine 22 is full of products, the timing element 24 will activate the micro-switch 27 so as to complete the circuit placing the switches 27 and 28 in series such that the solenoid 23 is activated. The solenoid 23 includes a plunger 23*a* that upon actuation is connectable to the spring trigger 22*a* of the drop-shelf magazine 22. Such actuation triggers each drop shelf 22*b* one at a time in a manner consistent with known drop-shelf magazines. As the timing element 24 energizes the solenoid only momentarily, the spring trigger 22*a* is allowed to fall back to its original position and await the next vend.

Figure 3:
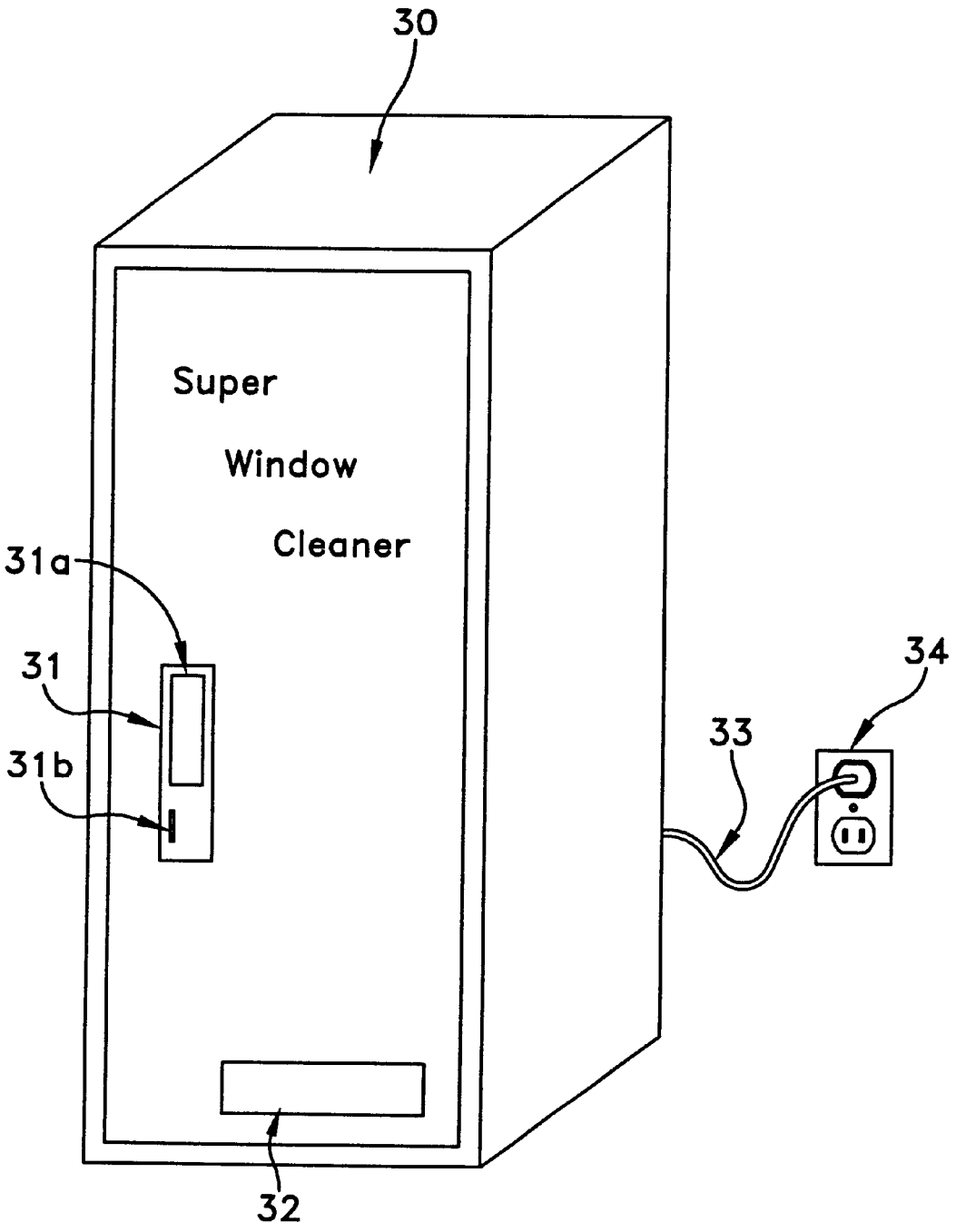
FIG. 3 is a perspective view of the automatic electronic drop-shelf device according to the present invention.

FIG. 3 is a perspective view of the present invention that is shown in schematic in FIG. 2. In particular, it should be noted that the device 30 of the present invention is preferably encased as shown in order to be a compact, self-contained vending machine. The front of the device 30 preferably includes a selection panel 31 where coins or the like are inserted into a coin acceptor 31*b*. The selection panel 31 includes an indicator area 31*a* that displays the empty indicator (element 21 of FIG. 2) as well as the coin count display and currency display. Of course, if other types of monetary input is used (e.g., tokens, paper currency, credit cards, and the like), then the particular display may be altered somewhat. However, such variation is considered well within the intended scope of the present invention. The device 30 also includes a delivery door 32 where the selected product is ultimately deposited for acceptance by the user. As the device is preferably designed to run off of 120V AC, the device 30 is shown with its plug 33 inserted into a standard wall outlet 34.

Figure 4:
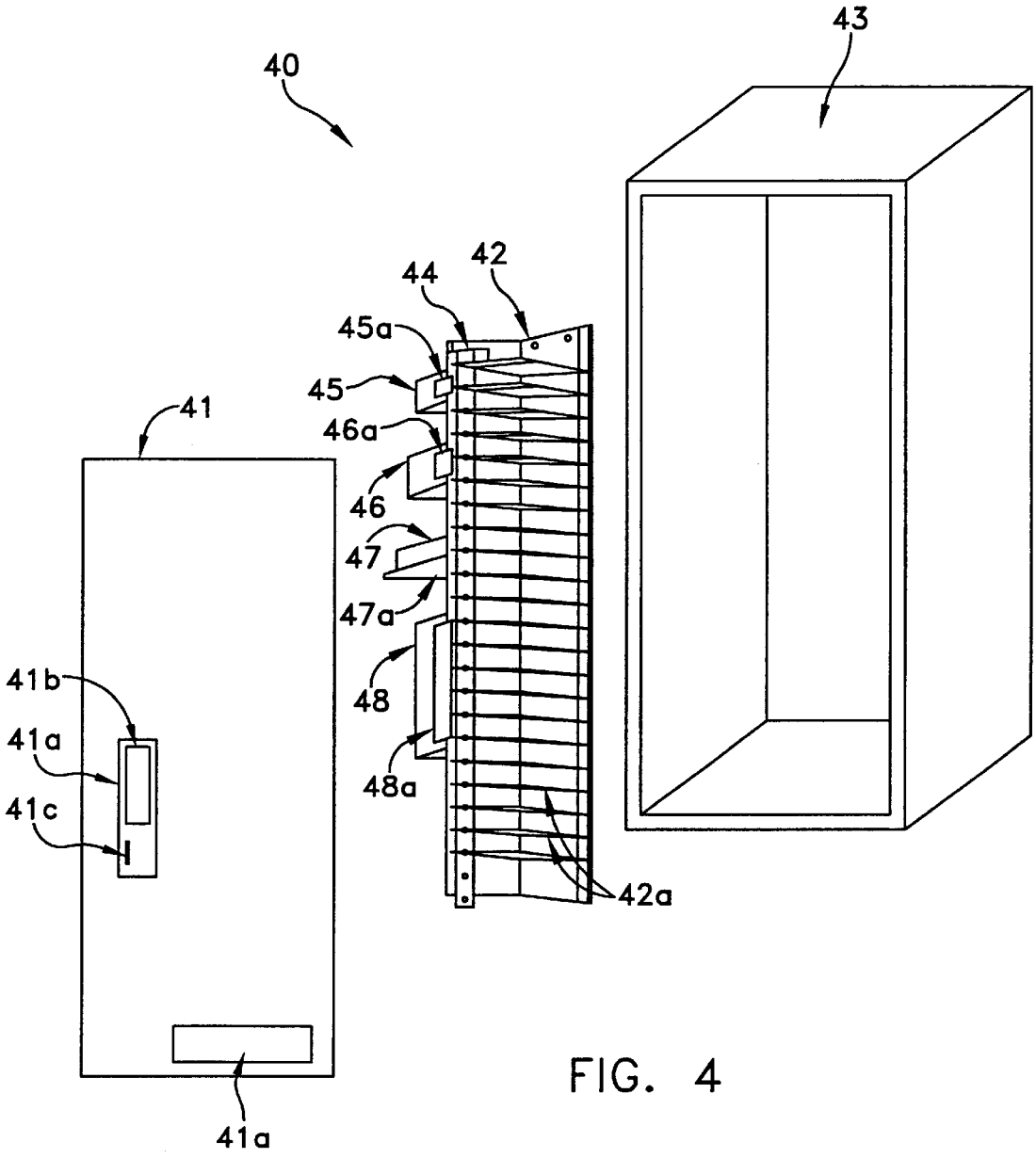
FIG. 4 is an exploded view of the automatic electronic drop-shelf device according to the present invention shown in FIG. 3.

FIG. 4 shows an exploded view of the device 40 according to the present invention. For the sake of illustrative clarity, all wiring has been omitted. However, as mentioned, wiring harnesses typically found in the electronics art are the preferred method of connection. Specifically, the device 40 includes a case 43 and cover 41 preferably fabricated from sheet metal or some similar durable material. Attachment of the cover 41 to the case 43 may be by any known method including hinges, latches, locks, bolts, or screws (not shown). As in FIG. 3, the cover 41 includes a delivery door 41*d* and a selection panel 41*a* where coins or the like are inserted into a coin acceptor 41*c*. The selection panel 41*a* also includes an indicator area 41*b* as discussed above. The inner workings of the device 40 are shown utilizing a single drop-shelf magazine 42. However, multiple magazines may be utilized with minimal changes and without straying from the scope of the present invention.

With continued reference to FIG. 4, the drop-shelf magazine 42 includes drop shelves 42*a*. The basic design and structure of the drop-shelf magazine 42 is consistent with known designs common in the vending art. To the drop-shelf magazine 42 are mounted each element shown schematically in FIG. 2. Such mounting is accomplished by bolting or welding supports (45*a*, 46*a*, 47*a*, and 48*a*) between the mounted element and the drop-shelf magazine 42. More specifically, the micro-switch 44 is mounted atop the drop-shelf magazine as shown. The larger components that include the terminal block 45, the timing element 46, the solenoid 47, and the electronic coin acceptor 48, are each mounted using either a bracket or support. While a preferred arrangement is shown, it should be noted that any configuration is possible so long as the specific elements are included.

It should be understood that the preferred embodiments mentioned here are merely illustrative of the present invention. Numerous variations in design and use of the present invention may be contemplated in view of the following claims without straying from the intended scope and field of the invention herein disclosed.

I claim:

1. An electronic drop-shelf vending device for automatic vending of a consumer product, said device comprising:

a) a power supply;

b) a case;

c) a cover;

d) a first switch;

e) at least one drop-shelf magazine housed within said case, each said drop-shelf magazine having a plurality of drop shelves and a triggering mechanism;

f) each said at least one drop-shelf magazine consisting of a single electromechanical actuator connectable to each said triggering mechanism;

g) an electronic monetary detection means for accepting a form of money and outputting a first electronic signal; and h) a timing element for activating said solenoid in response to said first electronic signal upon closing of said first switch by a user;

wherein said triggering mechanism drops a bottom-most one of said plurality of drop shelves during actuation of said electromechanical actuator.

2. The device as claimed in claim 1, wherein said timing element is programmable with a predetermined value such that activation of said electromechanical actuator occurs only upon detection of said predetermined value by said monetary detection means.

3. The device as claimed in claim 2, said device further including a second switch and an empty indicator wherein said timing element energizes said empty indicator via said second switch when all said plurality of drop shelves have been dropped.

4. The device as claimed in claim 3, wherein said first switch is a normally open, push-button switch.

5. The device as claimed in claim 4, wherein said second switch is a normally open, micro-switch.

6. The device as claimed in claim 5, wherein said power supply is a 24V AC/DC transformer.

7. An electronic drop-shelf vending device for automatic vending of a consumer product, said device comprising:

a) a power supply;

b) a case;

c) a cover having a selection panel and a delivery door;

d) a first switch;

e) at least one drop-shelf magazine housed within said case, each said drop shelf-magazine having a plurality of drop shelves and a triggering mechanism;

f) each said at least one drop-shelf magazine consisting of a single electromechanical actuator connectable to each said triggering mechanism;

g) an electronic monetary detection means for accepting a form of money and outputting a first electronic signal, said electronic monetary detection means being connectable to said selection panel; and h) a timing element for activating said solenoid in response to said first electronic signal upon closing of said first switch by a user;

wherein said triggering mechanism drops a bottom-most one of said plurality of drop shelves during actuation of said electromechanical actuator such that a consumer product located on said bottom-most of said plurality of drop shelves is removed to said delivery door.

8. The device as claimed in claim 7, wherein said timing element is programmable with a predetermined value such that activation of said electromechanical actuator occurs only upon detection of said predetermined value by said monetary detection means.

9. The device as claimed in claim 8, said device further including a second switch and an empty indicator wherein said timing element energizes said empty indicator via said second switch when all said plurality of drop shelves have been dropped.

10. The device as claimed in claim 9, wherein said first switch is a normally open, push-button switch and said second switch is a normally open, micro-switch.

11. The device as claimed in claim 10, wherein said power supply is a 24V AC/DC transformer.

12. The device as claimed in claim 11, wherein said electronic monetary detection means is an electronic coin detector.

13. The device as claimed in claim 12, wherein said indications external to said device are realized at a location remote from said device.

14. An electronic drop-shelf vending device for automatic vending of a consumer product, said device comprising:

a) a power supply;

b) a case;

c) a cover having a selection panel and a delivery door, said selection panel having an empty indicator light;

d) a first switch;

e) at least one drop-shelf magazine housed within said case, each said drop shelf-magazine having a plurality of drop shelves and a triggering mechanism;

f) each said at least one drop-shelf magazine consisting of a single electromechanical actuator connectable to each said triggering mechanism;

g) an electronic monetary detection means for accepting a form of money and outputting a first electronic signal, said electronic monetary detection means being connectable to said selection panel; and h) a timing element for activating said solenoid in response to said first electronic signal upon closing of said first switch by a user;

wherein said triggering mechanism drops a bottom-most one of said plurality of drop shelves during actuation of said electromechanical actuator such that a consumer product located on said bottom-most one of said plurality of drop shelves is removed to said delivery door.

15. The device as claimed in claim 14, wherein said timing element is programmable with a predetermined value such that activation of said solenoid occurs only upon detection of said predetermined value by said monetary detection means.

16. The device as claimed in claim 15, said device further including a second switch wherein said timing element energizes said empty indicator light via said second switch when all said plurality of drop shelves have been dropped.

17. The device as claimed in claim 16, wherein said first switch is a normally open, push-button switch, said second switch is a normally open, microswitch, and said power supply is a 24V AC/DC transformer.

18. The device as claimed in claim 17, wherein said electronic monetary detection means is an electronic coin detector.

19. The device as claimed in claim 1, wherein said mechanical actuator is a solenoid.

20. The device as claimed in claim 7, wherein said mechanical actuator is a solenoid.

21. The device as claimed in claim 14, wherein said mechanical actuator is a solenoid.

* * * * *